United States Patent [19]

Roth

[11] 4,222,676

[45] Sep. 16, 1980

[54] MASSAGE CONTAINER HAVING A DOUBLE CLOSURE

[75] Inventor: Erich Roth, Bad Ems, Fed. Rep. of Germany

[73] Assignee: Dr. Wachter Kurmittel GmbH, Bad Ems, Fed. Rep. of Germany

[21] Appl. No.: 956,895

[22] Filed: Nov. 2, 1978

[30] Foreign Application Priority Data

Nov. 3, 1977 [DE] Fed. Rep. of Germany ..... 2749156
Aug. 24, 1978 [DE] Fed. Rep. of Germany ..... 2836995

[51] Int. Cl.[3] ..... A46B 11/00

[52] U.S. Cl. ..... 401/28; 220/254; 220/306; 220/379; 401/37; 401/183; 401/286; 401/290

[58] Field of Search ..... 222/206, 215; 220/306, 220/254, 379; 215/306; 401/6, 26, 28, 37, 39, 183–186, 137, 261, 265, 286, 290, 287, 291, 288, 285, 268, 282

[56] References Cited

U.S. PATENT DOCUMENTS

| | | | |
|---|---|---|---|
| 489,697 | 1/1893 | Taylor | 401/183 |
| 1,979,218 | 10/1934 | Bergstrom et al. | 401/183 X |
| 2,301,917 | 11/1942 | Johnson | 220/379 X |
| 2,532,429 | 12/1950 | Sparkman | 401/183 |
| 3,090,070 | 5/1963 | Simons | 401/183 X |
| 3,372,832 | 3/1968 | Yeater et al. | 220/254 |
| 3,930,599 | 1/1976 | Brothers et al. | 220/306 X |
| 4,143,667 | 3/1979 | Peilet | 401/28 |

FOREIGN PATENT DOCUMENTS

| | | | |
|---|---|---|---|
| 160450 | 4/1904 | Fed. Rep. of Germany . | |
| 431375 | 7/1926 | Fed. Rep. of Germany . | |
| 480615 | 8/1929 | Fed. Rep. of Germany . | |
| 1904134 | 6/1964 | Fed. Rep. of Germany . | |
| 345868 | 6/1960 | Switzerland | 401/183 |
| 430291 | 6/1935 | United Kingdom . | |

*Primary Examiner*—Steven A. Bratlie
*Attorney, Agent, or Firm*—Toren, McGeady and Stranger

[57] ABSTRACT

A container for substances for the cleaning and care of the human body. The container has a container body and a removable cap and is particularly adapted to receive liquid substances. The removable cap is provided with massaging means and closes off a filling opening of the container body. The cap has at least one opening extending from the inside to the outside and also has a removable closure.

6 Claims, 3 Drawing Figures

MASSAGE CONTAINER HAVING A DOUBLE CLOSURE

FIELD OF THE INVENTION

The invention relates to a container for substances for the cleaning and care of the human body, particularly for those in liquid form, such as liquid used for a shower bath, having a container body and a removable cap which is provided with massaging means and closes off a filling opening of the container body. The cap having massaging means provided, has at least one passage which extends from the inside toward the outside and also has a removable closure.

BACKGROUND OF THE INVENTION

In a known container of this type (German Pat. No. 403,223), the cap is screwed onto the container body which is provided with a wide filling opening, wherein the surface of the cap provided with the massaging means essentially corresponds to the cross-sectional area of the filling opening. In this design, a satisfactory sealing of the cap relative to the container body is only ensured as long as the container body does not consist of a relatively elastic material. However, this would be desirable in order to be able to convey, by applying pressure on the container body, the substances for the cleaning and the care of the human body to the surface which is provided with the massaging means. When the container body of the container of this type is constructed of a relatively soft material, as would be advantageous for the above-described reasons, a satisfactory sealing between the cap and the container body can only be ensured if the filling opening and, thus, the available massaging surface is chosen significantly smaller than the largest transverse dimension of the container body.

Similar problems also occur in a device for washing and massaging, as described in German Pat. No. 160,450, since satisfactory sealing is also not ensured also when the container body as well as the cap consists of a flexible material. As a result, the substances for the cleaning and the care of the human body may leak out in a disadvantageous manner at the connection point between the cap and the container body. In the massaging device according to the German Pat. No. 431,375, instead of a cap closing off the filling opening of the container body, a plate with massaging means is provided. This plate is connected to the container body by means of an annular nut. In this device, it is not possible to make the massaging surface as large as desired if, in a manner compatible with the human body, a flexible material is used for the cap, since, also in this case, sealing problems will soon occur, as it is also the case in the similarly constructed massaging device according to the German Pat. No. 480,615. In the brush for massaging head and body, as described in the German Utility Model No. 1,904,134, sealing problems cannot occur, since the massaging surface is rigidly connected to the container body. However, this is, of course, disadvantageous inasfar as a refilling of the brush with substances for the cleaning and the caring of the human body is not possible. On the other hand, in the massaging device according to the British Pat. No. 430,291, because of the screw connection used in this case between cap and container body, a satisfactory sealing can only be ensured when the massaging surface is relatively small. This is the case unless a relatively inflexible material were used for cap and container body which would be disadvantageous.

SUMMARY OF THE INVENTION

The invention is directed toward the creation of a container of the above-mentioned type, wherein, independently of the properties of the material of cap and container body, particularly in a relatively elastic cap and a relatively elastic container body, a reliable and secure sealing of the filling opening towards the outside is ensured in addition to a mounting of the cap on the container body which is rigid and secured against turning.

According to the invention this task is solved, in part, in providing two connection means between the container body and the cap with the container body having a rounded-off, oblong shape of a piece of soap. The first connection is effected so that that surface of the container body which is covered by the cap is offset by a circumferential edge which is provided with a circumferential groove and that inner bulges of the cap engage the circumferential groove for a secure mounting. For a simultaneous sealing action, the second connection is effected in that an annular projection provided with a circumferential flange extends outwardly from the surface of the container body, which annular projection is engaged by an annular bulge of an annular web which extends inwardly from the cap.

Due to the fact that, according to the invention, a twofold connection between the cap and the container body is ensured, namely by the inner bulge of the cap interacting with the circumferential groove of the container body and also by the interaction of the annular projection provided with the circumferential flange with the annular bulge of the annular web of the cap, it is guaranteed that the cap can be securely fastened at the container body even when the cap and the container body are of an elastic material and the massaging surface is very large. In addition, a twofold sealing action is achieved because any liquid which is to reach the outside from the interior of the container body first would have to pass the first sealing effected by the annular bulge of the annular web in interaction with the circumferential flange of the annular projection and, subsequently, the second sealing effected by the interaction of the inner bulge of the cap with the circumferential groove of the circumferential edge of the container body.

An especially preferred embodiment of the invention is distinguished by the fact that, within the annular web, there is provided another annular web which reaches into the filling opening surrounded by the annular projection and sealingly rests against the annular projection. As a result, the sealing action is improved even further, since the inner sealing, in this case, is constructed, so to speak, in the form of two individual sealings, because the annular web sealingly resting from the inside against the annular projection creates an additional sealing.

However, while the inventive container could, of course, also be constructed in such a manner that the hollow space of the cap located outside of the annular web surrounding the filling opening is connected to the massaging surface through one or several passages, an advantageous further development of the invention is distinguished by the fact that within the annular web there opens out at least one passage exists since, as a result, the hollow space surrounding the annular web and located within the circumferential edge of the cap becomes available as a safety space for sealing which could receive any substances for the cleaning and the care of the human body which may possibly have passed through the first sealing and could prevent the substances from being discharged to the outside.

Another embodiment of the invention in which, in an advantageous manner, a complete sealing of the container, particularly of the passage through the surface of the cap which is provided with the massaging means is ensured even when the container is not in use, is distinguished by the fact that the container body has a pocket-like wall recess in that surface which is not covered by the cap, this pocket-like wall recess being able to receive a plug by means of which it is possible to close the passage of an elevation when the container is not in use, after the elevation forming the passage extending from the inside toward the outside and being provided with a removable closure, has been cut off.

In a further development of this embodiment, it may be provided that the plug has an essentially plane circular cover plate and a conically widening portion which is connected to an essentially cylindrical portion which is connected to the cover plate. Moreover, it may be provided that the container body is made of an elastic material and the wall recess has an inwardly protruding annular lip whose diameter is smaller than the outer diameter of the conical portion of the plug.

In the above-described three embodiments, the wall of the container body consisting of an elastic plastic material has an inwardly directed pocket-like recess and the removable plug is elastically held in this pocket. As a result, after cutting off the extended elevation containing the passage of the massaging surface, a means is available to the user of the container by means of which the passage of the cut-off elevation can be reliably and reversibly closed after the container has been used. When the user once again wants to use the container, it is merely necessary to once again pull the plug provided with a wide cover plate which facilitates a grasping with the fingernails out of the passage of the cut-off elevation and to safely store the plug in the wall pocket while the container is used. After the use of the container is concluded, the plug is once again pulled out of the wall pocket and is once again inserted into the passage of the cut-off elevation. The inventively provided, conically expanding shape, in connection with the annular lip of the wall pocket in the above-described especially preferred embodiment, makes it possible to reliably receive the plug in the pocket-like wall recess while utilizing the elasticity of the wall of the container. It is especially advantageous to provide also the inner contour of the passage of the elevation to be cut off with the shape of an annular lip, since, in this case, an especially secure fastening of the plug in the passage is ensured. On the other hand, it may also be provided that the cylindrical portion of the plug has exactly such a length that the widened conical portion projects beyond that surface which is located opposite the surface of the cap provided with the massaging means. As a result, a secure sealing is ensured while utilizing the elastic material of the cap.

Additional features and advantages of the invention result from the following description in which an embodiment is explained in detail with the aid of the schematical drawing.

DESCRIPTION OF THE PREFERRED EMBODIMENT

Figure 1:
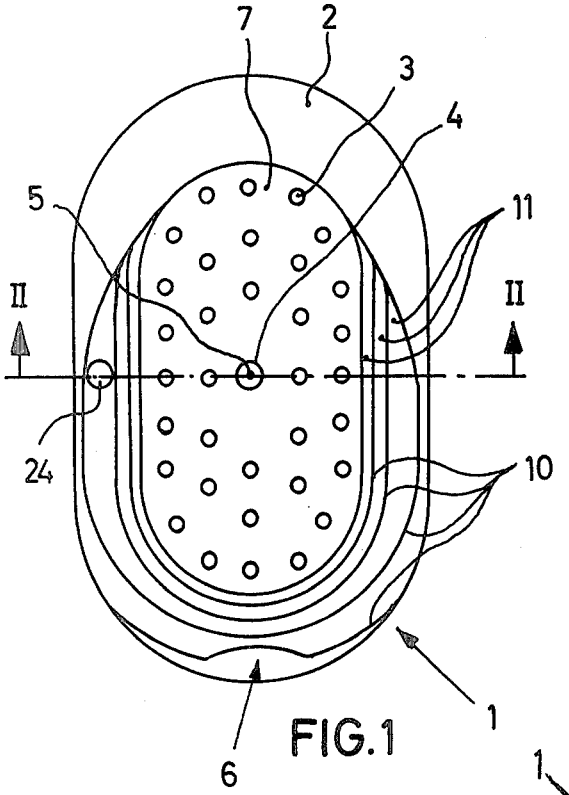
FIG. 1 shows an inventive container, as seen toward the cap surface which is provided with the massaging means.

As the drawing shows, the inventive container for substances for the cleaning and the care of the human body, in the shown embodiment, essentially has the shape of a rounded-off piece of soap. As a result, the container has excellent handling properties. On a bottom surface 2 of the container there is placed a cap 7 (see also FIG. 2) which is provided with a plurality of elevations 3 for massaging and through which a massaging effect is achieved when the container rubs the human skin. An elevation in the middle, to wit, the elevation 4, is provided with a passage 5 for the substance for the cleaning and the care of the human body, in the following called body cleaning liquid. Particularly on the sides and toward an end surface 6, the bottom surface 2 of the container body 1 is provided with arched grooves and bulges 11 which serve as a gripping and holding means and essentially extend on each longitudinal side of the surface 2 in the manner of an arch around the end surface 6, starting approximately at the middle of the respective longitudinal side. The cap 7 provided with elevations 3,4 sealingly closes the filling opening 8 of the container body. The surface 2 of the container body 1 covered by the cap 7 is slightly offset from the container body 1 by a circumferential edge 12. In the circumferential edge 12 of the container body 1 there is provided a circumferential groove 13 which extends along the entire circumferential edge. Inner bulges 14 of the cap 7 engage the circumferential groove 13. A filling opening 8 is sealed by an annular projection 15 which extends from the filling opening 8 toward the outside from the surface 2 of the container body 1. The annular projection 15 is provided with an outer circumferential flange 15' which is arranged at a distance from the surface 2 of the container body 1. In the cross-section, the circumferential flange 15' has the shape of sawteeth (see FIG. 2), wherein that side of the circumferential flange 15' which extends perpendicularly from the annular projection faces toward the surface 2, while the inclined side of the circumferential flange 15' faces outwardly. An annular web 16 extending inwardly from the cap 7 interacts with the annular projection 15 and the annular flange 15'. This annular web 16 surrounds the annular projection 15 when the cap is mounted. The annular web 16 has an inner angular bulge 16' which is able to engage the saw-toothed circumferential flange 15' of the annular projection 15 and, thus, sealingly secures the cap 7 at the container body 1.

When the cap 7 is placed on the container body 1, the annular bulge 16' of the annular web 16 slides downwardly on the inclined side of the circumferential flange 15' until the annular bulge 16' engages that side of the circumferential flange 15' which extends perpendicularly from the annular projection 15. The sealing of the filling opening 8 is improved thereby that, within the annular web 16, another annular web 18 extends from the surface of the cap 7 provided with the elevations 3 toward the interior 17 of the container body 1. The annular web 18 frictionally, sealingly engages the annular projection 15 at the surface 2 of the container body 1. In this manner, the annular projection 15 is sealed by the annular web 16 from the outside and by the annular web 18 from the inside.

Figure 2:
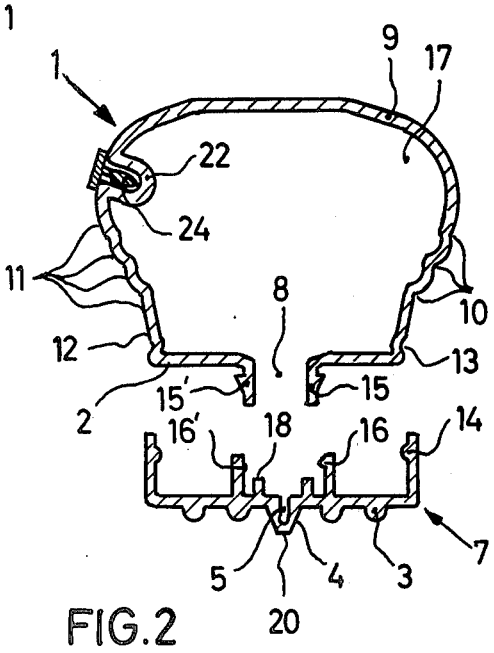
FIG. 2 shows a section along the line II—II of FIG. 1, the cap provided with elevations and liquid passage and massaging means being removed from the container body.

As FIG. 2 shows, in the shown embodiment, the elevation provided with a passage 5 projects beyond the elevations 3 which have no passages 5. Before using the container and for shipping, the passage 5 of the elevation is closed by a closure 20 which is formed in one piece with the entire elevation and, thus, with the cap 7 of an elastic plastic or rubber material. For opening the passage 5 of the elevation 4, the closure 20 is cut off. As a result, the passage 5 of the elevation 4 is opened and its height, originally projecting beyond the other elevations 3, is reduced to, or praticularly below, the height of the other massaging elevations 3.

Figure 3:
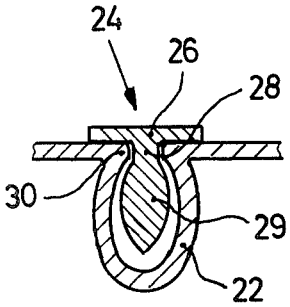
FIG. 3 shows a section, in an enlarged scale, through the plug and the wall recess of the container body receiving this plug.

In the shown embodiment, the wall of the container is arched inwardly to form a wall recess 22 (FIG. 2), the resulting pocket releasably elastically holding a plug 24. The container is shipped as shown in FIG. 2 filled with body cleaning liquid, wherein, accordingly, the point or closure 20 of the elevation 4 is not cut off and the plug 24 is received in the wall recess 22. FIG. 3 shows that the plug 24 has an essentially plane, circular cover plate 26, a straight cylindrical portion 28 extending therefrom, and a conically widening portion 29. By interacting with an annular lip 30 of the wall recess 22 (FIG. 3), the widened portion 29 ensures a secure elastic holding of the plug 24 in the wall recess 22. The widened cover plate 26, in turn, facilitates the removal of the plug 24 from the wall recess 22, for example, by grasping the cover plate 26 with the fingernails.

When the container is to be used, the tip or closure 20 of the elevation 4 is cut off. After the use of the container is concluded, the user takes the plug 24 out of the wall recess 22 and inserts it into the passage 5 of the elevation 4. The conical portion 29 of the plug 24 now engages that surface of the cap which, as seen in FIG. 2, faces away from the massaging surface of the cap 7 located at the bottom. As a result, a reliable sealing of the passage 5 is ensured. In the closed state achieved in this manner, the container cannot only be put down in any desired position without the danger of leaking of the body cleaning liquid out of the passage 5, but can also be placed and transported in a travelling bag. For a renewed use, the plug 24 is once again removed from the elevation 4 and, during use, is inserted in the wall recess 22. Subsequently, after the use is concluded, the above-described procedure follows.

The features of the invention disclosed in the above description, in the drawing and in the following claims can be essential individually as well as in any combination of the realization of the invention in its various embodiments.

I claim:

1. A container for substances for the cleaning and the care of the human body, particularly for those in liquid form, such as a liquid for a shower bath, comprising:

a container body;

a removable cap which is provided with massaging means and closes off a filling opening of said container body;

massaging means being provided in the surface of said cap, said cap also being provided with at least one passage which extends from the inside toward the outside and has a removable closure;

said container body having a rounded-off, oblong shape of a piece of soap;

two connection means being provided between said container body and said cap wherein, as a first connection means, the surface of said container body which is covered by said cap is offset by a circumferential edge provided with a circumferential groove, inner bulges of said cap engaging said circumferential groove for support; and as a second connection means, an annular projection provided with a circumferential flange and extending outwardly from said surface of said container body, said annular projection being engaged by an annular bulge of an annular web which extends inwardly from said cap, said first and second connection means providing simultaneous sealing action for the container.

2. A container according to claim 1, wherein, within said annular web, there is provided an annular web which reaches into said filling opening surrounded by said annular projection and sealingly rests from the inside against said annular projection.

3. A container according to claim 1, wherein at least one passage opens out within said annular web.

4. A container according to claim 1, wherein, outside of said surface which is covered by said cap, said container body has a pocket-like wall recess which can receive a plug by means of which a passage of an elevation extending from the inside toward the outside can be closed when said container is not used, after a removable closure of said elevation has been cut off.

5. A container according to claim 4, including a plug having an essentially plane, circular cover plate, and a conically widening portion which is connected to an essentially cylindrical portion which, in turn, is connected to said cover plate.

6. A container according to claim 5, wherein said container body is made of an elastic material and said wall recess has an inwardly projecting annular lip whose diameter is smaller than the outer diameter of said conical portion of said plug.

* * * * *